US010311706B2

(12) United States Patent
M et al.

(10) Patent No.: US 10,311,706 B2
(45) Date of Patent: Jun. 4, 2019

(54) SYSTEM AND METHOD FOR SMART INTRUSION CONTROL USING WEARABLE BLE DEVICES

(71) Applicant: Honeywell International Inc., Morristown, NJ (US)

(72) Inventors: Satheesh Babu M, Madurai (IN); Dharmalingam Vediappan, Hosur (IN); Viswanathan Krishnan, Bengaluru (IN)

(73) Assignee: ADEMCO INC., Golden Valley, MN (US)

( * ) Notice: Subject to any disclaimer, the term of this patent is extended or adjusted under 35 U.S.C. 154(b) by 212 days.

(21) Appl. No.: 14/875,854

(22) Filed: Oct. 6, 2015

(65) Prior Publication Data

US 2017/0098367 A1 Apr. 6, 2017

(51) Int. Cl.

| | |
|---|---|
| ***G08B 25/00*** | (2006.01) |
| ***G08B 25/10*** | (2006.01) |
| *G08B 25/14* | (2006.01) |

(52) U.S. Cl.

CPC ..... *G08B 25/008* (2013.01); *G08B 25/10* (2013.01); *G08B 25/14* (2013.01)

(58) Field of Classification Search

CPC ..... G08B 25/008; G08B 25/10; G08B 25/14
See application file for complete search history.

(56) References Cited

U.S. PATENT DOCUMENTS 7,505,464 B2 3/2009 Okmianski et al.
8,714,449 B2 5/2014 Jentoft
2003/0125961 A1* 7/2003 Janda ..... G06Q 10/087 705/307
2012/0019353 A1* 1/2012 Knasel ..... G05B 23/0229 340/4.35
2014/0007264 A1 1/2014 Berger
2014/0013455 A1* 1/2014 Berger ..... G06F 21/55 726/36
2014/0049361 A1* 2/2014 Ahearn ..... G07C 9/00309 340/5.7
2014/0243015 A1* 8/2014 Basha ..... G01S 5/0226 455/456.1
2015/0130608 A1 5/2015 Sharma et al.
2015/0163412 A1* 6/2015 Holley ..... G05B 15/02 348/143
2016/0123741 A1* 5/2016 Mountain ..... G01C 21/206 701/533
2016/0174913 A1* 6/2016 Somanath ..... A61B 5/747 600/301

OTHER PUBLICATIONS

Extended European search report for corresponding EP patent application 16192114.3, dated Dec. 23, 2016.

* cited by examiner

*Primary Examiner* — Omer S Khan
(74) *Attorney, Agent, or Firm* — Husch Blackwell LLP

(57) ABSTRACT

An apparatus including a building automation system that protects a secured geographic area, a plurality of non-overlapping geographic zones within the secured area, at least one portable Bluetooth device carried by an authorized human user within the secured area, a Bluetooth receiver associated with each of the plurality of zones that detects the portable device proximate the zone and a security controller that arms and disarms at least one of the plurality of zones based upon the detection of the portable device proximate the at least one zone.

6 Claims, 1 Drawing Sheet

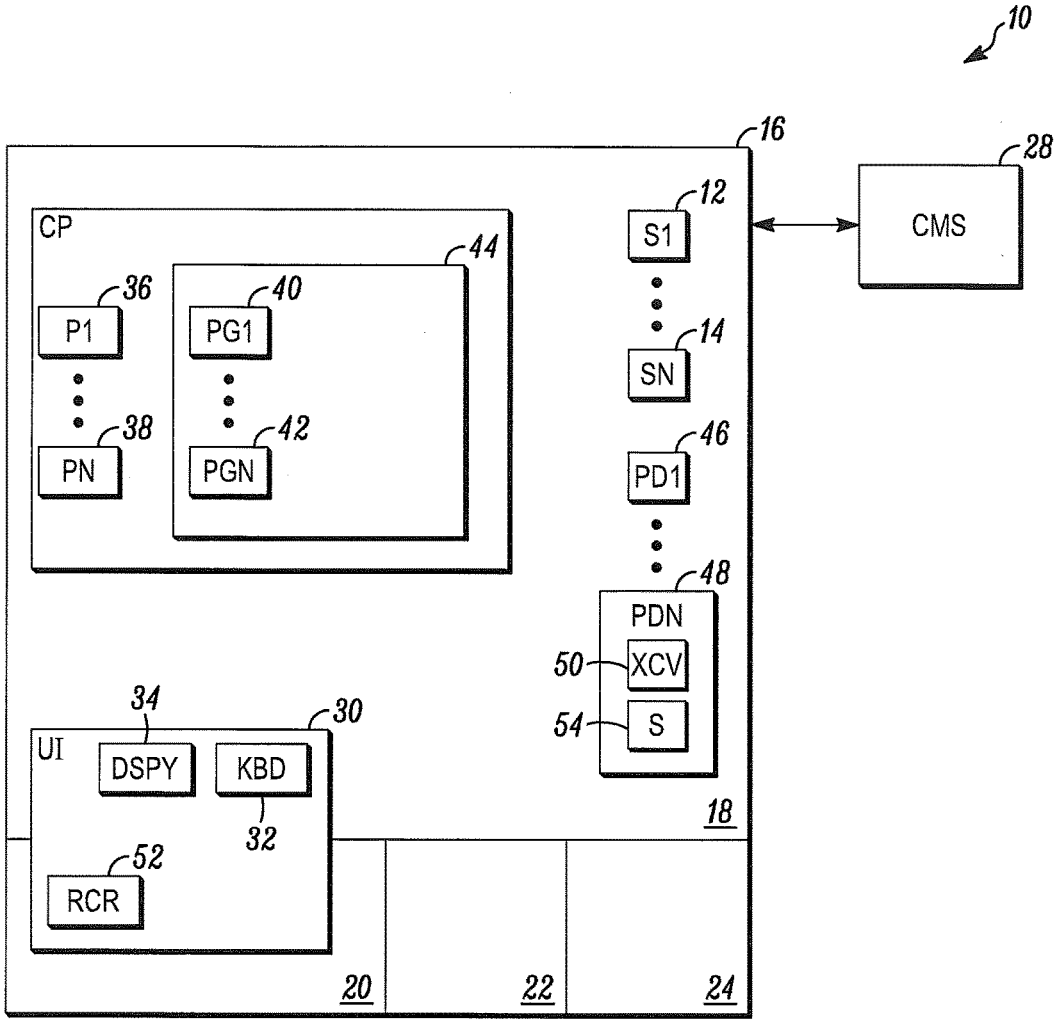
10
16
28
CMS
12
S1
14
SN
46
PD1
48
PDN
50
XCV
54
S
CP
44
36
P1
38
PN
40
PG1
42
PGN
34
30
UI
DSPY
KBD
32
52
RCR
18
20
22
24

SYSTEM AND METHOD FOR SMART INTRUSION CONTROL USING WEARABLE BLE DEVICES

FIELD

This application relates to security systems and more particular to the arming and disarming of such systems.

BACKGROUND

Systems are known to protect people and assets within secured areas. Such systems are typically based upon the use of one or more sensors that detect threats within the areas.

Threats to people and assets may originate from any number of different sources. For example, a fire may kill or injure occupants who have become trapped by a fire in a home. Similarly, carbon monoxide from a fire may kill people in their sleep.

Alternatively, an unauthorized intruder, such as a burglar, may present a threat to assets within the area. Intruders have also been known to injure or kill people living within the area.

In the case of intruders, sensors may be placed in different areas based upon the respective uses of those areas. For example, if people are present during some portions of a normal day and not at other times, then sensors may be placed along a periphery of the space to provide protection while the space is occupied while additional sensors may be placed within an interior of the space and used when the space is not occupied.

In most cases, threat detectors are connected to a local control panel. In the event of a threat detected via one of the sensors, the control panel may sound a local audible alarm. The control panel may also send a signal to a central monitoring station.

While conventional security systems work well, it is sometimes difficult or inconvenient to arm and disarm the system while traveling through areas with different security levels. Accordingly, a need exists for better methods and apparatus for arming and/or disarming such areas.

BRIEF DESCRIPTION OF THE DRAWINGS

FIG. 1 illustrates a block diagram of a home automation system in accordance herewith.

DETAILED DESCRIPTION

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

FIG. 1 is a block diagram of a security system 10 shown generally in accordance with an illustrated embodiment. Included within the system are a number of sensors 12, 14 that detect threats within a secured geographic area 16. The secured area may be divided into a number of zones 18, 20, 22, 24 each having a different level of security.

The sensors may be embodied in any of a number of different forms. For example, at least some of the sensors may be limit switches attached to doors and/or windows providing entrance into and egress from the secured area or travel among the zones. Other of the sensors may be passive infrared (PIR) sensors placed within the interior of the area or each of its zones in order to detect intruders who have been able to circumvent the sensors placed along the periphery. Still other of the sensors may be closed circuit television (CCTV) cameras with motion detection capabilities for detecting intruders.

The sensors may be monitored by a control panel located within one of the zones (as shown in FIG. 1) or located remotely. Upon activation of one of the sensors, the control panel may send an alarm message to a central monitoring station 28. The central monitoring station may respond by summoning the police.

The security system may be controlled by one or more user interfaces 30 placed proximate entrances into the secured area and/or each of its zones. In this regard an authorized human user may enter a personal identification number (PIN) and activate a function key through a keyboard 32 to arm or disarm the security system or a portion of the security system within any of the zones. Status information regarding any entered instructions may be shown on a display 34.

For example, a user may enter his/her PIN and a disarm instruction through a user interface in order to enter the secured area. Once inside, the user may enter an arm stay command to re-activate the sensors along the perimeter and in order to provide intrusion detection while the user is inside the secured area.

Similarly, while inside the secured area with the perimeter sensors activated, the user may choose to move from a zone having a lesser level of security to a zone having a higher level of security. In this case, the user may be required to re-enter his/her PIN and a disarm command to enter the area with the higher level of security. Upon leaving the area with the higher level of security and re-entering the area with the lower level of security, the user may be required to re-arm the portion of the security system in the zone with the higher level of security.

Included within the control panel, sensors and user interfaces may be control circuitry that accomplishes the functionality disclosed herein. The control circuitry may include one or more processor apparatus (processors) 36, 38 operating under control of one or more computer programs 40, 42 loaded from a non-transitory computer readable medium (memory) 44. As used herein, reference to a step performed by a computer program is also reference to the processor that executed that step.

Under the illustrated embodiment, the security system (or portions thereof) may be automatically deactivated and/or activated via a respective portable wireless device 46, 48 carried by each of a plurality of authorized human users. In this regard, the portable devices may each include a radio frequency transceiver 50 that transmits a low energy signal (e.g., a Bluetooth low energy signal) containing identifying information. A radio frequency receiver or transceiver 52 associated with each zone (e.g., located within the user interface of the zone) may detect the user and automatically disarm the zone as the user approaches and re-arm the portion as the user departs the area of the zone.

The portable devices may be any device (e.g., a smartphone) with Bluetooth capability. An access request program executed on a processor within the portable device may transmit an access request to the user interface as the user approaches an entrance to the zone.

Within the user interface, a corresponding access processor may periodically transmit a beacon for the benefit of portable devices within the area. The beacon may include information that identifies the beacon as being from the security system. The portable device may detect the beacon, authenticate the source of the beacon and, in response, transmit an access request. The access request may include identification information of the authorized user.

The access processor within the user interface may detect the access request and processes it accordingly. For example, the processor or transceiver may determine a distance separating the user interface and the portable device via an indicator of signal strength (e.g., received signal strength indication (RSSI), bit error rate (BER), etc.). The processor may also compare the indicator of signal strength with a threshold value in order to detect the user arriving at a predetermined distance from the edge of the zone.

The access processor or an associated processor within the control panel may also authenticate the identification information of the user. Upon authenticating the access request as being from an authorized user, the access processor may disarm the portion of the security system associated with the user interface. The processor may also activate an electric lock providing physical access by the user into the zone.

In addition to distance, a location processor of the control panel may determine a location of the portable device. For example, upon transmitting an access request, 2 or more user interfaces may detect a relative distance of the portable device from each user interface. Where the request is detected by three or more user interfaces, the geographic location of the user may be determined. Where the request is detected by 2 or more user interfaces, then the direction of travel of the user may be determined. Using location, the access processor may re-arm the portion of the security system as the user departs the area of the zone.

Another processor within the control panel may also determine a relative speed of travel of the user. This may be accomplished by processing the signal detected by a single user interface or by determining a change in the relative position of the user within the secured area. In this regard, speed may be used to anticipate a time of arrival of the user at the location of a different zone and disarm or arm the zone as the user arrives at a border of the zone. In this regard, a processor may adjust the distance threshold for arming or disarming the system based upon speed of the user.

The portable device may also include one or more sensors 54 that detects a physiological parameter of the user (e.g., heart rate, blood pressure, respiration, etc.). In this regard, a health processor of the portable device may process the physiological parameters of the user to determine a health state of the user.

The determined health state of the user may be included within the access request and used to arm and disarm the system as required. For example, upon detecting a health condition requiring an ambulance, a processor may disarm one or more zones or the entire security system.

Using one or more of distance, location, and health of the users, a system control processor may generate a list of zones to be armed and/or disarmed. In this regard, the relatively closest zone may be first on the list for arming or disarming. If the user is moving away from the closest zone, then upon reaching the threshold distance, the zone is armed. If the user is moving towards the zone, then the zone is disarmed as the user exceeds the threshold distance.

Similarly, the health and travel speed of the user may be used to adjust the list and threshold values associated with the list. If the health of the user is compromised, then the list may include each zone separating the user from an entrance used by paramedics. In this case, the threshold may be set to disarm each zone through which the paramedics would travel.

Similarly, if a measured health parameter were to indicate an impending health problem and the user were to be traveling in a particular direction at a relatively rapid speed, then the list would be generated based upon the speed, the direction of travel and the severity of the health problem.

In general, currently available intrusion system require manual intervention for arm/disarm zones in a facility. Even if a validated user is within a zone, he/she has to manually disarm the system. The user must open an app on his smartphone or physically go to the keypad of the system to change the control. There is no location based or intelligent mechanism to remotely control the zones.

Also, the sensors of an entire building will be activated if the system is armed and vice versa. Granular control for arming & disarming the zones/partitions is not available. This problem is applicable for power & temperature management in the building also.

In the solution depicted in FIG. 1, BLE/Low Range RF based wearable devices are used to identify distance between the operator and the first accessible system component/location of a user or a security guard of the premise. When the operator/user enters particular area within the range of the (nearest) zones in the area the same can be disarmed. This range/distance factor allows the system to identify the potential zones to be included in an Arm/dis-arm Zone list. This range can be varied based on the situation.

An operator (user) is not be allowed to disarm the system if he is not in the range of the particular zone he is trying to disarm. When an operator navigates from one zone to another, the new zones within the range of the operator will automatically be disarmed and the zone from which the operator came will get armed automatically.

This solution works in 3 stages. First, the location of the operator/User is identified within the premises. Second, the system finds the appropriate zones based on identified location. Third, the system sends Arm/Dis-arm command to the zones based on operator location.

When a user enters into the premises, user the wearable devices start communicating with the intrusion system using BLE/RF transponders. Based on the signal strength, an accurate distance between the Tag carried by the user and the transponder of the security system is calculated. This distance helps the master controller decide whether a single or multiple zone are to be armed/disarmed. The information from the BLE/Wearable will also be used to authenticate the user to ensure that the user is indeed a valid user who has the privilege and authority to arm/disarm the system.

The system identifies the appropriate zones based upon the location of the user. This stage of operation generates a list of zones to be armed/disarmed during the user movement. The criteria to generate the list may be based upon one or more criteria and can be combined for the effectiveness. The list of zones selected categorizes the current state of the system. For example in emergency situation, the list of zones will include all zones to make an emergency movement faster for the occupants. Other cases based upon the speed of people movement combined with health factors of the user allows the system to form the zone list in such a way that the zones in the pathways will be disarmed for faster operations.

Preparation of the zone list may happen during any one of the event described below. For example, a gadget (portable device) may report data from one or more health monitors in the form of an alert/notification. In the case of the gadget reporting any high or low health signals, the system will trigger the intrusion system to generate the dis-arm zones list in such a way that the user can move easily to an exit.

The system allows for faster User movement between zones. Within the premises, if the user moves relatively faster than a normal movement speed, then the system will generate the dis-arm/arm zones list of larger radius to adjust to the speed of the user.

The system may adjust to the number of people in a single zone. Within the premises if large numbers of users are gathered in a single zone, the system will use their health monitors alerts/notification as sources of information to assess the situation, if there exists any abnormality, a larger number of zones within a larger radius of the current location will be determined.

The system can also accommodate user behavior/threat based arm/disarm situations. In this case, the system aggregates the health monitor alerts/notifications from all users in the premises to predict the current state/threat in the premises and generates a list of zones to dis-arm/arm to allow for a faster evacuation.

The system can also detect intruders misusing established entry procedures. For example, if an intruder tailgates to gain entry along with any one of the legitimate users, then the tailgated user cannot stay hidden in the premises because only the zones associated with the legitimate user will disarm on the movement of the legitimate user.

The system of FIG. 1 has a number of novel features. With regard to human factors, the system enriches user experience as the arm/dis-arm happens without manual key in process. In addition, all zones are always kept armed state except the zones where the users are staying. The system provides an intelligent way for selective arming/disarming intrusion system which improves the security of the premises. This can be used as a trigger to the building lighting system to selectively switch on/off the lights on the user are alone. This can be integrated with building HVAC system to maintain the room temperatures for the only occupied for power efficiency. This solution also detects tailgating with legitimate users.

In general, the system includes a building automation system that protects a secured geographic area, a plurality of non-overlapping geographic zones within the secured area, at least one portable Bluetooth device carried by an authorized human user within the secured area, a Bluetooth receiver associated with each of the plurality of zones that detects the portable device proximate the zone and a security controller that arms and disarms at least one of the plurality of zones based upon the detection of the portable device proximate the at least one zone.

Alternatively, the system may include a building automation system that protects a secured geographic area, a plurality of non-overlapping geographic zones within the secured area, at least one low energy wireless device carried by an authorized human user within the secured area, at least one low energy wireless receiver associated with each of the plurality of zones that determines a distance of the portable device from the zone and a security controller that arms and disarms each of the plurality of zones based upon the distance of the portable device from the zone.

Alternatively, the system may include a security system that protects a secured geographic area, a plurality of non-overlapping geographic zones within the secured area, a plurality of portable Bluetooth devices each carried by a respective authorized human user within the secured area, a Bluetooth receiver associated with each of the plurality of zones that determines a distance of each of the plurality of portable devices from the zone, a processor that determines a location of each of the plurality of portable devices within the secured area based upon the distance of the portable device from each of the zones and a security controller that arms and disarms each of the plurality of zones based upon the respective locations of each of the plurality of portable devices.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. An apparatus comprising:

a building automation system that protects a secured area;

a plurality of zones within the secured area;

a portable Bluetooth device carried within the secured area;

a respective Bluetooth receiver associated with each of the plurality of zones that detects the portable Bluetooth device when proximate to a first one of the plurality of zones and that determines a respective distance between the portable Bluetooth device and the first one of the plurality of zones; and a security controller that determines a direction of the portable Bluetooth device and a speed of the portable Bluetooth device by detecting a change in the respective distance between the portable Bluetooth device and the first one of the plurality of zones, wherein the security controller generates a list of multiple zones of the plurality of zones to disarm based on a current state of the building automation system, the direction of the portable Bluetooth device, the speed of the portable Bluetooth device, and the respective distance between the portable Bluetooth device and the first one of the plurality of zones when the respective Bluetooth receiver for the first one of the plurality of zones detects the portable Bluetooth device proximate to the first one of the plurality of zones, wherein the list includes a respective threshold distance for each of the multiple zones on the list, wherein the security controller determines when the portable Bluetooth device is within the respective threshold distance from a corresponding one of the multiple zones on the list, and responsive thereto, disarms the corresponding one of the multiple zones on the list, wherein the security controller adjusts the respective threshold distance for each of the multiple zones based on the speed of the portable Bluetooth device, wherein the portable Bluetooth device includes a sensor that measures a health parameter, and wherein the portable Bluetooth device compares the health parameter with a threshold value, and where the health parameter exceeds the threshold value, instructs the security controller to disarm each of the multiple zones on the list.

2. The apparatus as in claim 1 wherein the respective Bluetooth receiver associated with each of the plurality of zones measures an indicator of signal strength of the portable Bluetooth device.

3. The apparatus as in claim 2 wherein the indicator of signal strength includes one of a received signal strength indicator value and a bit error rate value.

4. The apparatus as in claim 1 wherein the building automation system is a security system.

5. An apparatus comprising:

a building automation system that protects a secured area;

a plurality of zones within the secured area;

at least one low energy wireless device carried within the secured area;

at least one respective low energy wireless receiver associated with each of the plurality of zones that detects the at least one low energy wireless device when proximate to a first one of the plurality of zones and that determines a respective distance between the at least one low energy wireless device and the first one of the plurality of zones; and a security controller that determines a direction of the at least one low energy wireless device and a speed of the at least one low energy wireless device by detecting a change in the respective distance between the at least one low energy wireless device and the first one of the plurality of zones, wherein the security controller generates a list of multiple zones of the plurality of zones to disarm based on a current state of the building automation system, the direction of the at least one low energy wireless device, the speed of the at least one low energy wireless device, and the respective distance between the at least one low energy wireless device and the first one of the plurality of zones when the at least one respective low energy wireless receiver for the first one of the plurality of zones detects the at least one low energy wireless device proximate to the first one of the plurality of zones, wherein the list includes a respective threshold distance for each of the multiple zones on the list, wherein the security controller determines when the at least one low energy wireless device is within the respective threshold distance from a corresponding one of the multiple zones on the list, and responsive thereto, disarms the corresponding one of the multiple zones on the list, wherein the security controller adjusts the respective threshold distance for each of the multiple zones based on the speed of the at least one low energy wireless device, wherein the at least one low energy wireless device measures a health parameter, and wherein the at least one low energy device detects a health crisis based upon a value of the health parameter and simultaneous thereto directs the security controller to disarm each of the plurality of zones.

6. The apparatus as in claim 5 wherein the security controller adjusts the list of the multiple zones based on the speed of the at least one low energy wireless device.

* * * * *